US011625006B2

(12) United States Patent
Garcin et al.

(10) Patent No.: US 11,625,006 B2
(45) Date of Patent: Apr. 11, 2023

(54) ROTATING BEZEL BLOCKING DEVICE

(71) Applicant: MONTRES TUDOR SA, Geneva (CH)

(72) Inventors: Gilles Garcin, Les Acacias (CH); Sacha Maffioli, Veigy-Foncenex (FR); Ludovic Zbylut, Seynod (FR)

(73) Assignee: MONTRES TUDOR SA, Geneva (CH)

( * ) Notice: Subject to any disclaimer, the term of this patent is extended or adjusted under 35 U.S.C. 154(b) by 609 days.

(21) Appl. No.: 16/818,313

(22) Filed: Mar. 13, 2020

(65) Prior Publication Data

US 2020/0292995 A1 Sep. 17, 2020

(30) Foreign Application Priority Data

Mar. 14, 2019 (EP) ..... 19162923

(51) Int. Cl.
*G04B 19/28* (2006.01)
*G04B 19/18* (2006.01)
*G04B 19/22* (2006.01)

(52) U.S. Cl.
CPC ..... *G04B 19/286* (2013.01); *G04B 19/18* (2013.01); *G04B 19/225* (2013.01); *G04B 19/283* (2013.01)

(58) Field of Classification Search
CPC .... G04B 19/18; G04B 19/225; G04B 19/283; G04B 19/286
See application file for complete search history.

(56) References Cited

U.S. PATENT DOCUMENTS 7,434,984 B2 10/2008 Hiranuma et al.
7,572,049 B2 8/2009 Hiranuma
8,235,587 B2 * 8/2012 Hiranuma ..... G04B 19/286 368/295
9,188,959 B2 11/2015 Bertrand et al.
2003/0123332 A1 * 7/2003 Hiranuma ..... G04B 19/286 368/295
2007/0253290 A1 * 11/2007 Aire ..... G04B 39/00 368/294
2008/0285391 A1 * 11/2008 Hiranuma ..... G04B 19/286 368/295
2009/0046542 A1 2/2009 Saunier
(Continued)

FOREIGN PATENT DOCUMENTS

CH 490 706 A 1/1970
CH 566 584 B5 9/1975
(Continued)

OTHER PUBLICATIONS

European Search Report and Written Opinion dated Oct. 16, 2019 issued in counterpart application No. EP19162923; w/ English machine translation (12 pages).

*Primary Examiner* — Daniel P Wicklund
(74) *Attorney, Agent, or Firm* — WHDA, LLP

(57) ABSTRACT

A case for a timepiece
having a middle,
a rotating bezel, and
a device for blocking the rotating bezel, the device including an end-link, mounted mobile relative to the middle between a first position capable of preventing the rotation of the rotating bezel and a second position capable of allowing the rotation of the rotating bezel, the end-link including an action and/or gripping portion arranged so as to allow the wearer of the timepiece to move the end-link relative to the middle, while wearing the timepiece.

20 Claims, 8 Drawing Sheets

(56) References Cited

U.S. PATENT DOCUMENTS

| | | | | |
|---|---|---|---|---|
| 2010/0220560 | A1* | 9/2010 | Hiranuma | G04B 19/286 368/295 |
| 2016/0109853 | A1 | 4/2016 | Kobayashi | |
| 2020/0292995 | A1* | 9/2020 | Garcin | G04B 19/18 |

FOREIGN PATENT DOCUMENTS

| | | | | |
|---|---|---|---|---|
| CH | 709425 | B1 * | 12/2017 | G04B 37/081 |
| EP | 494998 | A * | 1/1970 | G04B 37/1486 |
| EP | 1 564 607 | A1 | 8/2005 | |
| EP | 1890202 | A1 * | 2/2008 | G04B 19/283 |
| EP | 2 624 076 | B1 | 12/2014 | |
| JP | 2010185833 | A * | 8/2010 | G04B 19/286 |

* cited by examiner

ROTATING BEZEL BLOCKING DEVICE

This application claims priority of European patent application No. EP19162923.7 filed Mar. 14, 2019, the contents of which is hereby incorporated by reference herein in its entirety.

The invention relates to a case provided with a rotating bezel blocking device. The invention relates also to a timepiece comprising such a case. The invention relates finally to a method for operating such a timepiece or such a case.

Devices for blocking the rotation of a rotating bezel of a wristwatch are known from the prior art.

By way of example, the patent application U.S. Pat. No. 7,434,984 discloses a device for blocking the rotation of a rotating bezel of a wristwatch, which can be actuated through a translationally mobile pushbutton.

As another example, the patent application U.S. Pat. No. 7,572,049 discloses a device for blocking the rotation of a rotating bezel of a wristwatch, which can be actuated through elements that can each appear between two horns of a case. The manipulation of these translationally mobile elements can prove awkward because of their small sizes. Moreover, these elements, through their disposition between the annular seat of the middle of the case and the bottom surface of the bezel, do not mask the attachment systems linking the wrist band to the case.

The patent application US20160109853 discloses, for its part, a device for blocking the rotation of a rotating bezel implementing a bezel lock, which is mounted rotationally mobile on a flank of the case middle. This lock can be actuated through pushbuttons disposed on either side thereof. Thus, this lock is not sufficient in itself and requires ancillary actuation means.

An end-link is known from the patent CH490706 that is provided to delimit the axial endshake of a bezel, in order to propose a simplified design of such a bezel. When worn, the end-link has a single and unique so-called "working" predefined position in which the end-link is capable of prohibiting any rotational movement of the bezel. Only when the wrist band part is removed is the end-link made mobile, thus being able to free the bezel from the annular seat of the middle. To do this, the end-link is blocked in rotation by a bar for fixing a wrist band part to the middle when said part is articulated on the middle.

The aim of the invention is to provide a case that improves the cases known from the prior art. In particular, the invention proposes a case allowing a reliable and easy manipulation of a rotating bezel.

According to the invention, a case is defined by the following point 1.

1. A case for a timepiece including a middle, a rotating bezel, and a device for blocking the rotating bezel, the device including an end-link, mounted mobile relative to the middle between a first position capable of preventing the rotation of the rotating bezel and a second position capable of allowing the rotation of the rotating bezel, the end-link including an action and/or gripping portion arranged so as to allow the wearer of the timepiece to move the end-link relative to the middle, when wearing the timepiece.

Different embodiments of the case are defined by following points 2 to 12.

2. The case as defined in the preceding point, wherein the case includes a first axis (A1) of articulation of the end-link relative to the middle and in that the case comprises a second axis (A2) of fixing and/or of articulation of a wrist band part on the case, the first and second axes being parallel or substantially parallel.

3. The case as defined in the preceding point, wherein the distance between the first axis and the second axis is less than 10 mm or less than 5 mm.

4. The case as defined in one of the preceding points, wherein the case includes a position indexing element, in particular indexing in two positions, for the end-link relative to the middle, notably one or more clicks, in particular one or more ball clicks.

5. The case as defined in one of the preceding points, wherein the end-link includes a tooth intended to cooperate obstacle-wise, in the first position, with teeth of the bezel, notably top bezel teeth or bottom bezel teeth.

6. The case as defined in one of the preceding claims, wherein the middle includes two horns and the end-link has a width (La) corresponding substantially to a distance (L) separating two horns of the case.

7. The case as defined in one of the preceding points, wherein the middle includes two horns and the case includes a first shaft or a first bar housed between the two horns so as to pivotingly link the end-link relative to the middle.

8. The case as defined in one of the preceding points, wherein the case includes a system for linking the wrist band part to the middle and/or the case includes a second shaft or a second bar mechanically linking the end-link to a wristlet part.

9. The case as defined in one of preceding points, wherein the middle includes a base, notably forming a base added onto the rest of the middle, on which the end-link is mounted mobile.

10. The case as defined in the preceding point, wherein the middle includes two horns and the width (La) of the base corresponds substantially to a distance (L) separating two horns of the case.

11. The case as defined in points 9 or 10, wherein the middle includes two horns and the case includes a first shaft or a first bar housed between the two horns so as to mechanically link the base to the middle.

12. The case as defined in one of points 9 to 11, wherein the case includes a second shaft or a second bar mechanically linking the base to a wrist band part.

According to the invention, a timepiece is defined by point 13.

13. A timepiece, notably a wrist watch, includes a case as defined in one of the preceding points.

According to the invention, a method for operating a case or a timepiece is defined by point 14.

14. A method for operating a case as defined in one of points 1 to 12 or a timepiece as defined in point 13, wherein the method includes the following steps, these steps being notably implemented while the case or the timepiece is worn on the wrist of a wearer: First action of the wearer to position the end-link in the second position of the end-link so as to allow the rotation of the rotating bezel, stopping of the first action of the wearer and/or second action of the wearer to position the end-link in the first position of the end-link so as to prevent the rotation of the rotating bezel.

The attached figures represent, by way of examples, two embodiments of a timepiece according to the invention.

Figure 1:
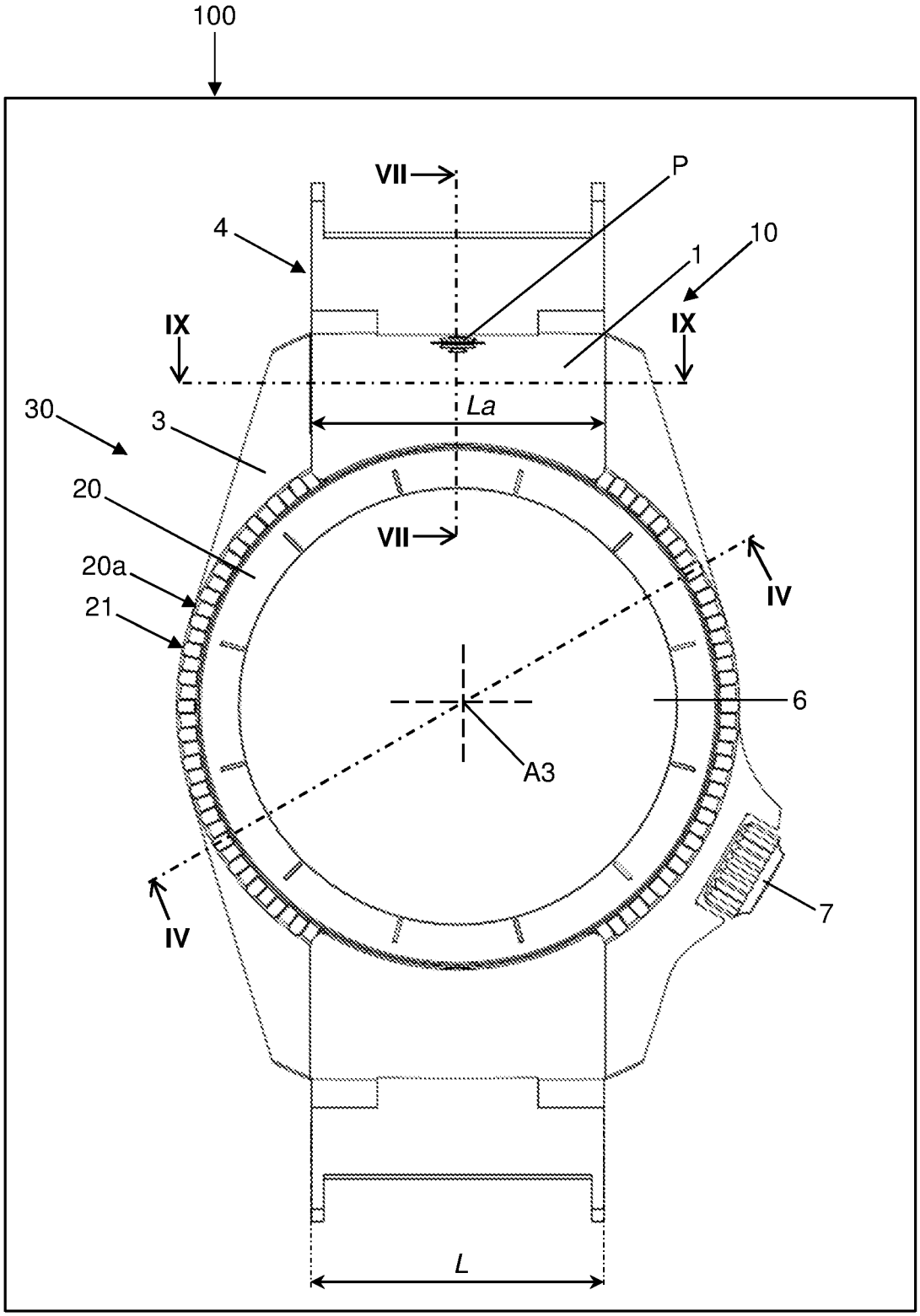
FIG. 1 illustrates a first embodiment of a timepiece according to the invention.
Figure 2:
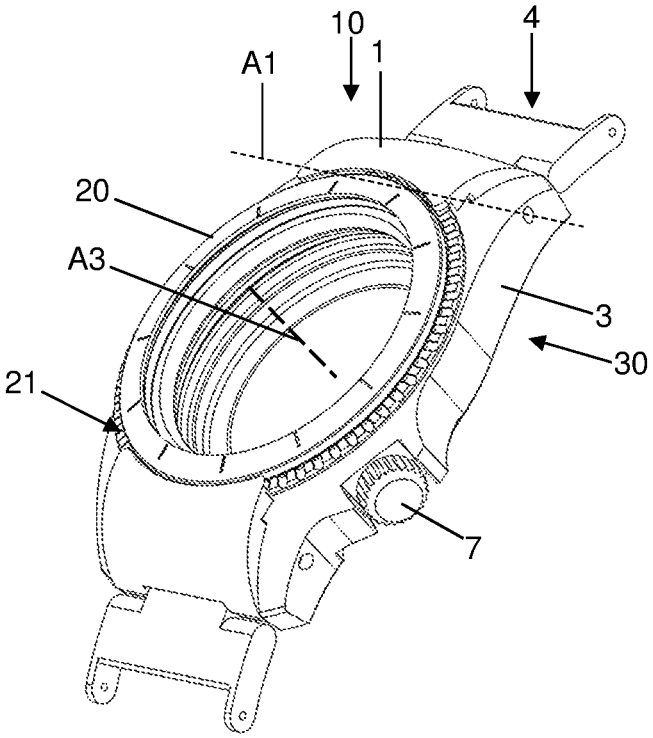
FIGS. 2 and 3 are perspective views of an example of a case of the first embodiment of a timepiece.

A first embodiment of a timepiece is described hereinbelow with reference to FIGS. 1 to 9. The timepiece is preferably a wrist watch 100.

The timepiece 100 comprises a case 30. This case is intended to contain a timepiece movement, notably an electronic movement or a mechanical movement, in particular an automatic movement.

The timepiece also comprises a wrist band linked mechanically to the case, in particular articulated on the case. The wrist band preferably comprises two wrist band parts 4 each comprising a first end fixed or articulated on the case and each comprising a second end intended to be fixed to a clasp.

The case 30 primarily comprises:

a middle 3, a bottom 5, a glass 6, a crown 7, and a rotating bezel 20.

These elements cooperate to form a sealed enclosure intended to receive the timepiece movement.

The rotating bezel is advantageously mounted rotationally mobile on the middle about an axis A3 of the middle. By virtue of such an arrangement, the wearer of the timepiece can use the rotating bezel bearing indications, to display information, notably time or time derivative information, defined by the angle of position of the rotating bezel relative to the middle and/or relative to a dial contained in the case.

The rotation of the bezel can be two-way. Alternatively, the rotation of the bezel can be one-way. In such a case, the case comprises an element allowing the rotation of the bezel in a first direction and prohibiting the rotation of the bezel in a second direction opposite the first direction.

Figure 4:
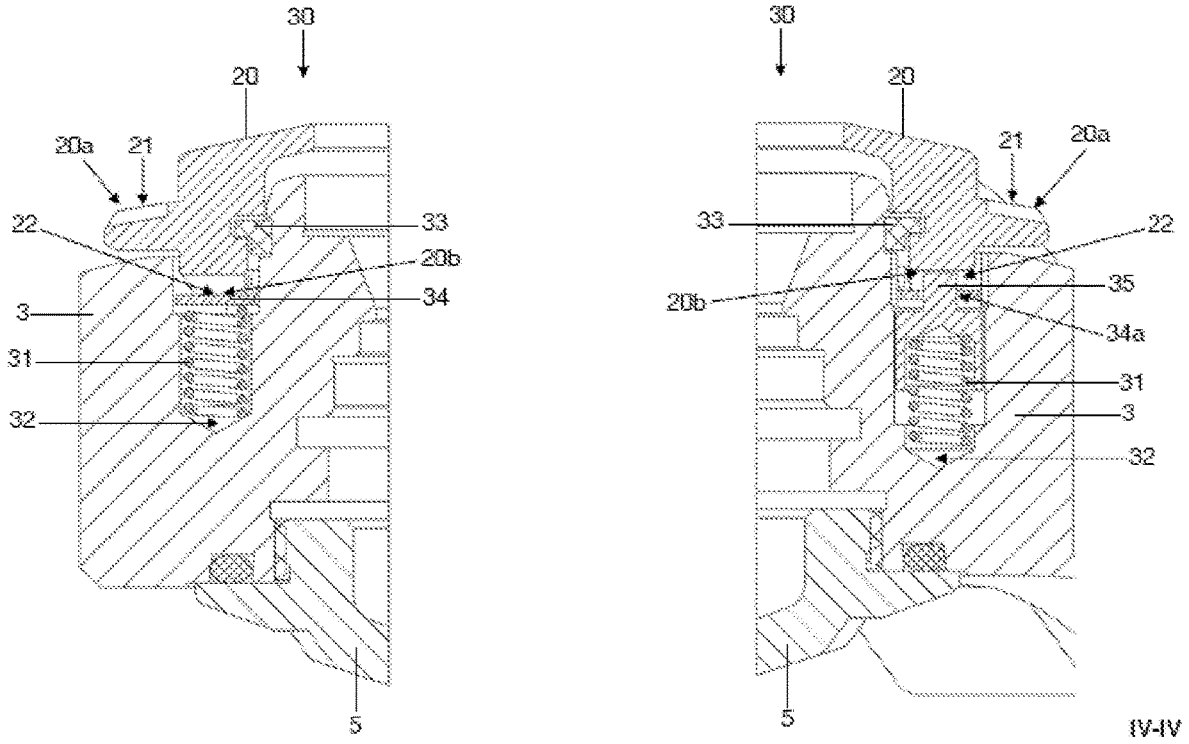
FIG. 4 is made up of cross-sectional views of an example of a case of the first embodiment of a timepiece, the cross sections being taken along the plane IV-IV of FIG. 1.

In a preferred embodiment of the rotating bezel 20, the latter has a design such as that disclosed in the patent EP2624076. Helical springs 31, disposed in housings 32 formed on an annular seat of the middle 3, press the bezel 20 against a ring 33 added onto the middle 3, through a ring 34 as represented in FIG. 4. Such a conformation allows the axial securing of the bezel, while imparting on it a torque resisting the rotation which is appropriate.

Also advantageously, the case comprises a system for notching or indexing the bezel in position relative to the middle. This system makes it possible to define a finite number of stable angular positions (for example 12, 24, 30, 60 or 120) that the bezel can occupy about the axis A3 relative to the middle.

Thus, optionally, a bottom surface 20*b* of the bezel 20 can comprise indexing teeth 22, provided to cooperate with a tooth 35 housed in the middle 3, so as to allow the notching of the bezel 20 as represented in FIG. 4. To do this, the tooth 35 can be disposed in a housing 32 of the middle and can be returned elastically by a spring such as a helical spring 31. The ring 34 can notably comprise a cutout 34*a* in order for the tooth 35 to be able to come directly into contact with the teeth 22.

The case also comprises a device 10 for blocking the rotating bezel 20, comprising an end-link 1, mounted mobile relative to the middle between a first position capable of preventing the rotation of the rotating bezel 20 and a second position capable of allowing the rotation of the rotating bezel 20.

This blocking device is notably provided to prevent any risk of untimely rotation of the bezel which could falsify information, in particular time or time derivative information, supplied by the latter.

The end-link comprises an action and/or gripping portion P arranged so as to allow the wearer of the timepiece to move the end-link relative to the middle, when wearing the timepiece. Thus, the blocking device is distinguished by the fact that it can be actuated by the end-link of the case, preferably mobile between at least two positions. In particular, the end-link is advantageously directly manipulable by the wearer by a simple action thereon.

"End-link" is understood to mean an element disposed at the level of a case to wrist band part attachment system, in particular between two horns of a middle of a case. This end-link is provided to mask the system of attachment of a wrist band part to the case, in particular when the timepiece is worn. Preferentially, the end-link comprises the system of attachment of the wrist band part to the case, which is advantageously conformed so that the latter cannot be visible to the wearer of the wrist watch, particularly when the timepiece is worn.

Figure 3:
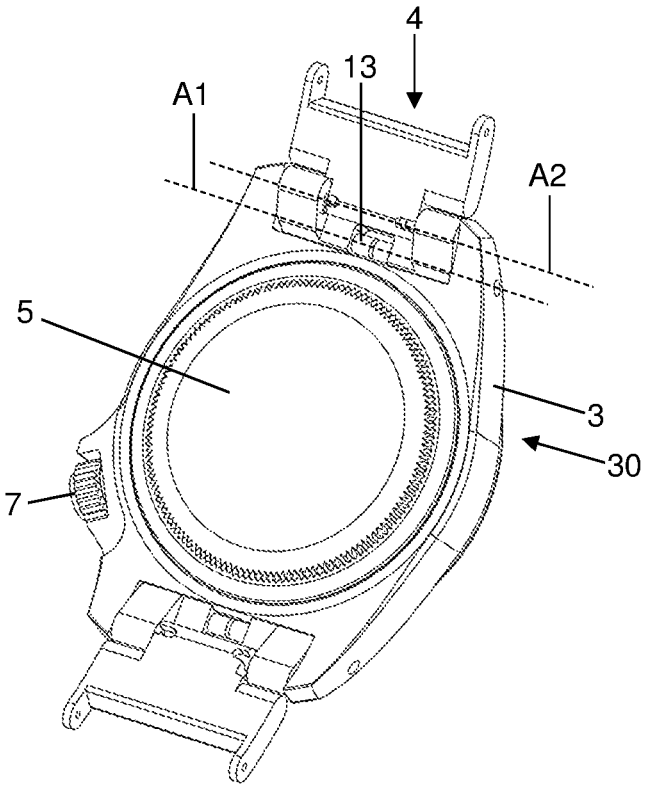
Figure 7:
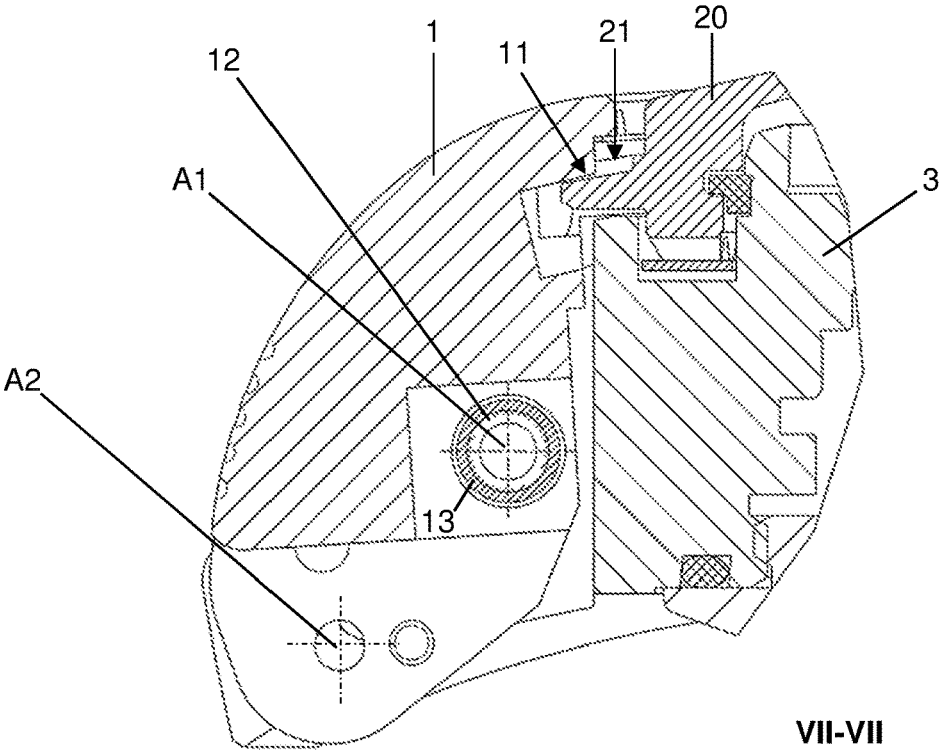
FIG. 7 is a cross-sectional view of an example of a case of the first embodiment of a timepiece, at the level of an end-link, the end-link being in a first configuration, the cross section being taken along the plane VII-VII of FIG. 1.
Figure 8:
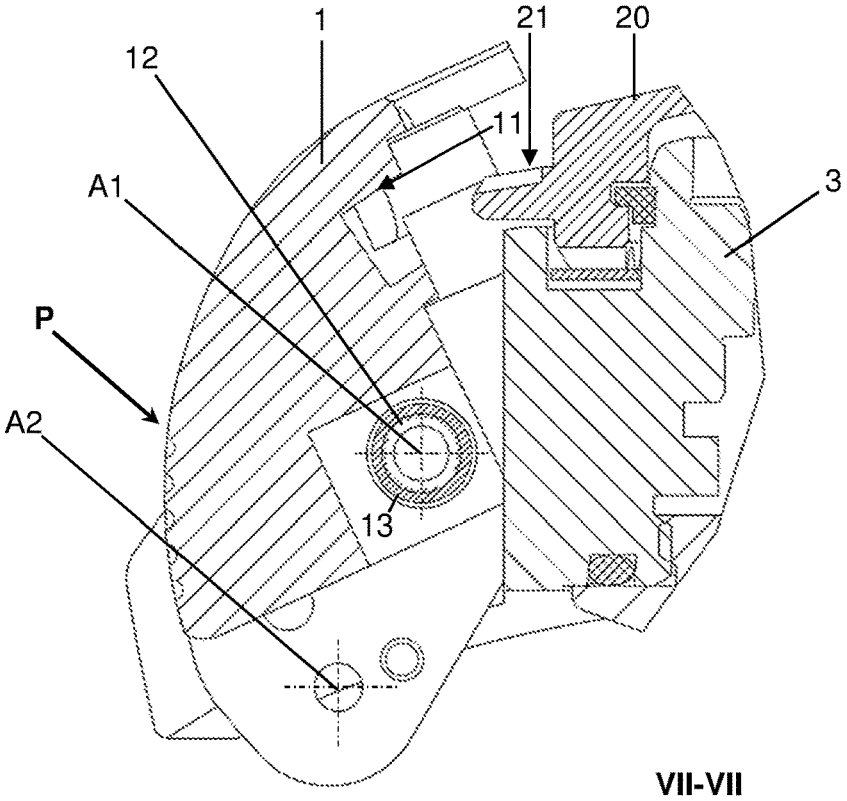
FIG. 8 is a cross-sectional view of an example of a case of the first embodiment of a timepiece, at the level of the end-link, the end-link being in a second configuration, the cross section being taken along the plane VII-VII of FIG. 1.

The end-link 1 is advantageously mounted rotationally mobile relative to the middle 3 about a first axis A1. Thus, the case advantageously comprises a first axis A1 of articulation of the end-link relative to the middle. For this, a shaft 12 of axis A1, as represented in FIGS. 7 and 8, is mounted in bores 36 of the middle 3, and in a through opening 15 of the end-link 1. The longitudinal shake of the shaft 12 relative to the middle 3 is, for its part, delimited by a ring 13 clipped onto the latter as represented in FIG. 3. Preferentially, the bores 36 are each formed on the horns 37 of the middle 3.

One of the wrist band parts is preferably fixed and/or articulated on the case about a second axis A2 of a system 40 for linking the part 4 of wrist band to the case 30. Thus, the case advantageously comprises a second axis A2 for fixing and/or articulation of the part 4 of wrist band to the case.

The first and second axes A1 and A2 are preferably parallel or substantially parallel. The distance between the first axis and the second axis is preferably less than 10 mm or less than 5 mm.

Advantageously, the end-link 1 can be directly manipulated by the wearer of the wristwatch by a simple action thereon, according to at least two positions. In a preferred embodiment of the blocking device 10, the end-link 1 can have two predefined stable positions or indexing positions corresponding respectively to a first configuration or position capable of blocking the bezel 20 and to a second configuration or position provided to release the bezel 20 and allow its rotation about the axis A3. For this, the case comprises a position indexing element 14, 38*a*, 38*b*, in particular indexing in two stable positions of the end-link relative to the middle. The indexing element preferably comprises one or more clicks, in particular one or more ball clicks.

Figure 6:
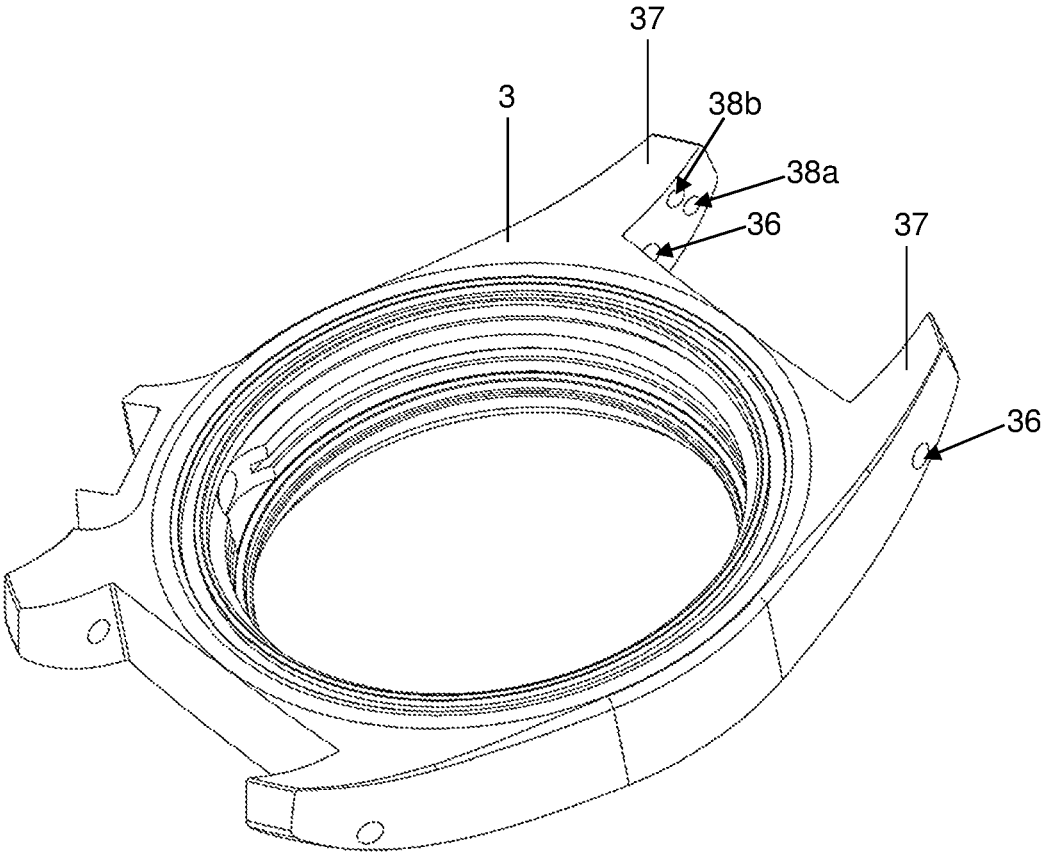
FIG. 6 is a perspective view of an example of a middle of the first embodiment of a timepiece.

The ball 14*a* of the at least one ball click is provided to be housed either in a first opening 38*a* of the middle 3, or in a second opening 38*b* of the middle 3 as represented in FIG. 6, thus defining the two predefined stable positions of the end-link relative to the middle.

Figure 9:
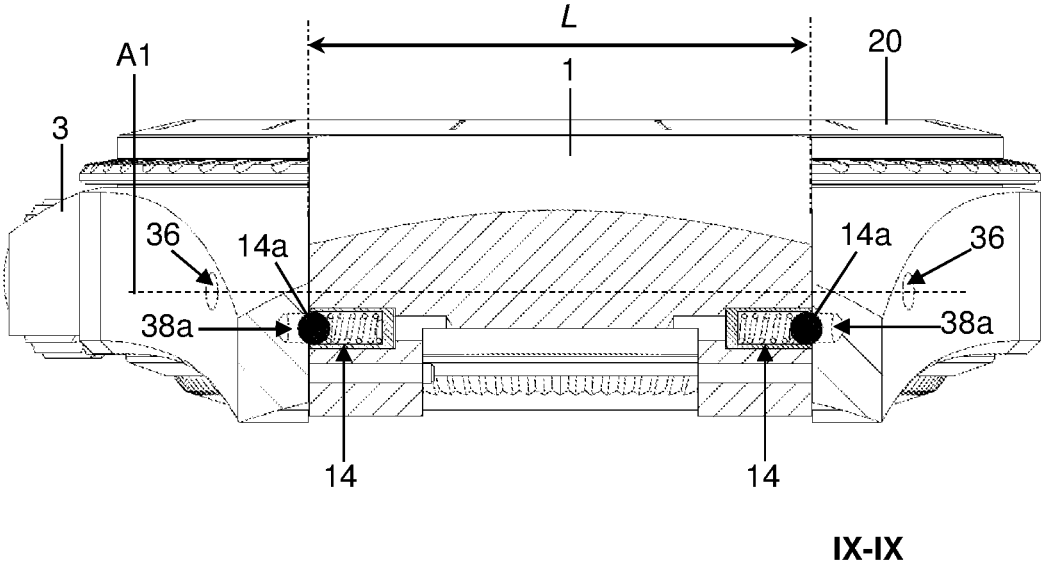
FIG. 9 is a cross-sectional view of an example of a case of the first embodiment of a timepiece, at the level of end-link position indexing elements, the cross section being taken along the plane IX-IX of FIG. 1.

Preferentially, the end-link 1 comprises two ball clicks 14, which are each disposed on either side of the end-link as represented in FIG. 9, so as to cooperate respectively with the openings 38*a*, 38*b*, which are preferentially formed on each of the horns 37 of the middle 3. Alternatively, the ball clicks can be produced in the horns and can cooperate with openings formed in the end-link.

Preferably, the end-link comprises at least one tooth 11 intended to cooperate obstacle-wise, in a first position of the end-link, with teeth 21 of the bezel, notably top bezel teeth, so as to allow the blocking of the bezel 20 in rotation about the axis A3 relative to the middle.

As represented in FIGS. 1 to 9 of the first embodiment, the first teeth 21 can be formed on a top surface 20*a* of the bezel 20. The second teeth 21 are therefore top teeth in this first embodiment.

In a first configuration of the blocking device 10, represented in FIG. 7, the tooth 11 of the end-link 1 is positioned between two consecutive teeth of the teeth 21, thus blocking the rotation of the bezel 20. For this, in this first configuration, the end-link 1 occupies a first position which is defined by the cooperation of the ball clicks 14 with each of the openings 38*a* as represented in FIG. 9.

A pressure on the action and/or gripping portion P of the end-link 1 by the user induces the rotation of the end-link 1, thus driving it from the first position to a second position defined by the cooperation of the ball clicks 14 with each of the openings 38*b*, corresponding to a second configuration of the blocking device. In this second configuration represented in FIG. 8, the end-link is positioned so that the tooth 11 is out of reach of the teeth 21, thus rendering the rotation of the bezel 20 possible about the axis A3 relative to the middle.

According to a preferred embodiment of the blocking device 10, the first teeth 21 cannot be retracted from the tooth 11 when the end-link 1 occupies the first position. Thus, the blocking device 10 preferably constitutes a device for blocking the rotation of the bezel 20.

Preferentially, the first teeth 21 and the indexing teeth 22 have the same number of teeth, such that the first teeth 21 can be indexed appropriately with respect to the tooth 11 of the end-link 1 for all the positions defined by the indexing teeth 22. Alternatively, the number of teeth of the indexing teeth 22 can be a multiple or a divisor of the number of teeth of the first teeth 21. As an example, the first teeth 21 and/or the indexing teeth 22 can comprise 12, 24, 30, 60 or 120 teeth.

According to a simplified embodiment of the blocking device 10, the first teeth 21 can be retracted from the tooth 11 even while the end-link 1 occupies the first position, for example by applying a pressure on the bezel against the springs 31 of the middle, notably when the bezel 20 is not provided with second teeth 22. Thus, the blocking device 10 constitutes, at least, a device for axially blocking the bezel 20, and could thus replace, at least partially, the axial securing ring 33 of the bezel so as to implement a simplified bezel 20 design.

The end-link preferably has a width La corresponding substantially to the distance L separating two horns 37 of the case. Preferably, this width and this distance are equal, to within a functional play. Thus, the width of the end-link 1 corresponds substantially to the distance separating two horns 37 of one and the same pair of horns of the middle 3.

Figure 5:
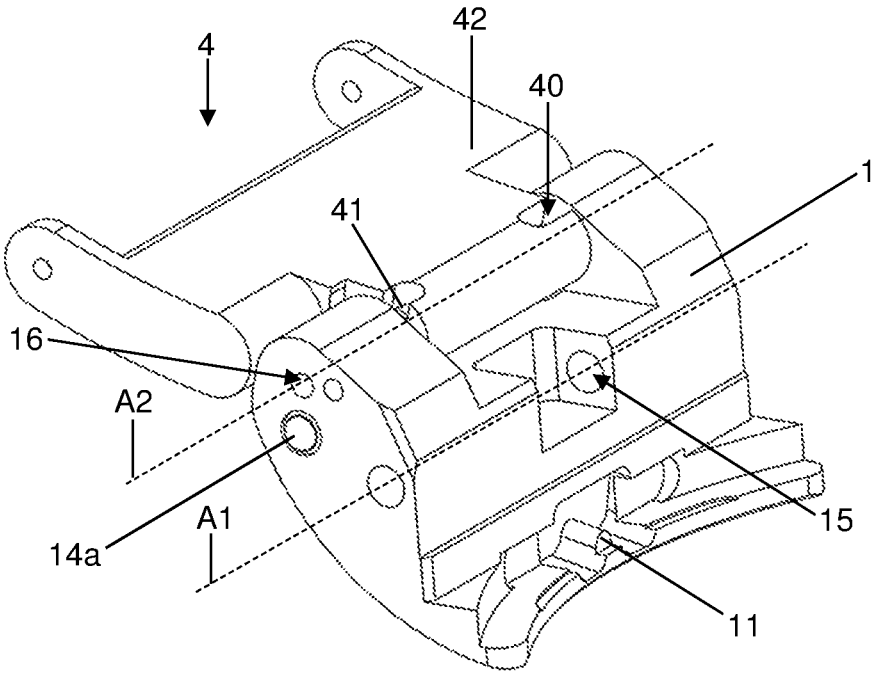
FIG. 5 is a perspective view of an example of an end-link of the first embodiment of a timepiece.

Preferentially, the case comprises a second shaft 41 or a second bar mechanically linking the end-link to the part 4 of the wrist band. Thus, the part 4 of the wrist band is linked to the middle 3 via the end-link 1. More particularly, the end-link 1 comprises the system 40 for linking the part 4 of the wrist band to the middle. This link system 40 can, for example, take the form of a conventional link. This system can, for example, comprise bar 41 extending along the second axis A2 and housed in openings 16 of the end-link 1. This bar is advantageously provided to pivot a first link 42 of the part 4 of the wrist band as represented in FIG. 5.

Alternatively, the end-link 1 can cover, at least partially, a link of a part directly linked to the case, in particular to the middle.

In the first embodiment of the blocking device 10, the end-link 1 takes the form of a one-piece component. The bezel 20 also takes the form of a one-piece component.

A second embodiment of a timepiece is described hereinbelow with reference to FIGS. 10 to 14.

In this second embodiment, any element that is identical to, similar to or has the same function as an element of the first embodiment can bear the same reference symbol as that of the element of the first embodiment.

The second embodiment differs from the first embodiment in that the first teeth 21 are formed on a bottom surface 20*b* of the bezel 20, i.e. bottom teeth 21. Thus, in addition to its cooperation with the tooth 11 of the end-link 1, these first teeth 21 can optionally cooperate with a tooth 35 housed in the middle 3, so as to allow a notching of the bezel 20, as was explained previously in relation to the first embodiment.

Alternatively, or in addition, the second embodiment can differ from the first embodiment in that the middle comprises a base 3*b*, notably a base added onto the rest of the middle, on which the end-link is mounted mobile. In this case, the base advantageously has a width La corresponding, to within a functional play, to a distance L separating two horns of the middle of the case. Furthermore, the case can comprise a shaft 12 or a bar housed between the two horns so as to mechanically link the base to the middle.

The second embodiment can differ from the first embodiment only by the features raised in one or other of the preceding two paragraphs.

Figure 12:
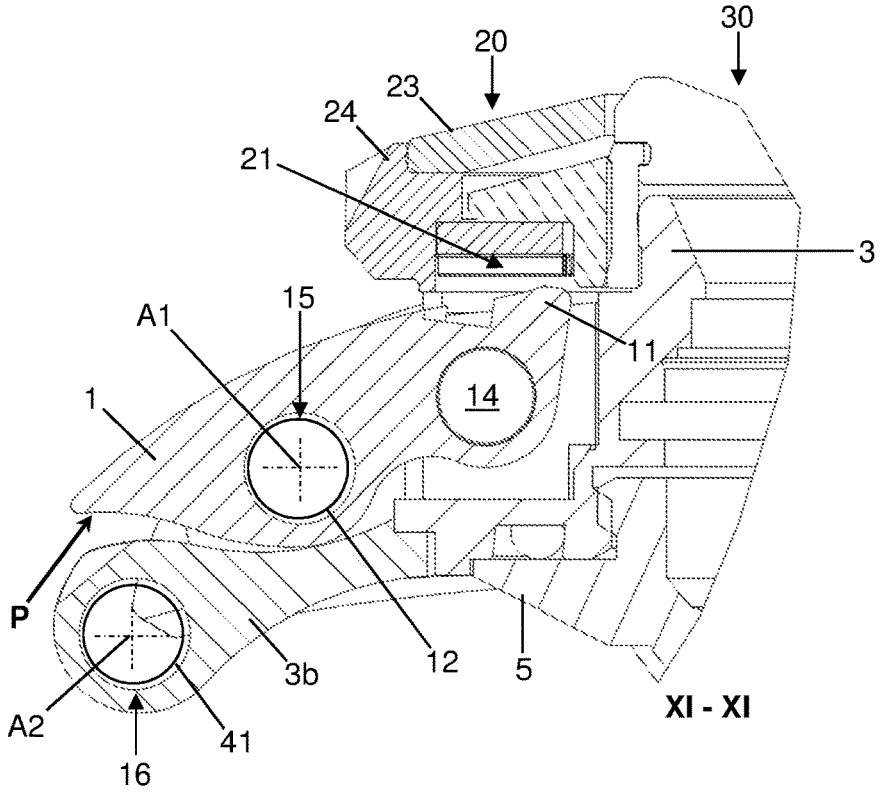
FIG. 12 is a cross-sectional view of an example of a case of the second embodiment of a timepiece, at the level of the end-link, the end-link being in a second configuration, the cross section being taken along the plane XI-XI of FIG. 10.
Figure 13:
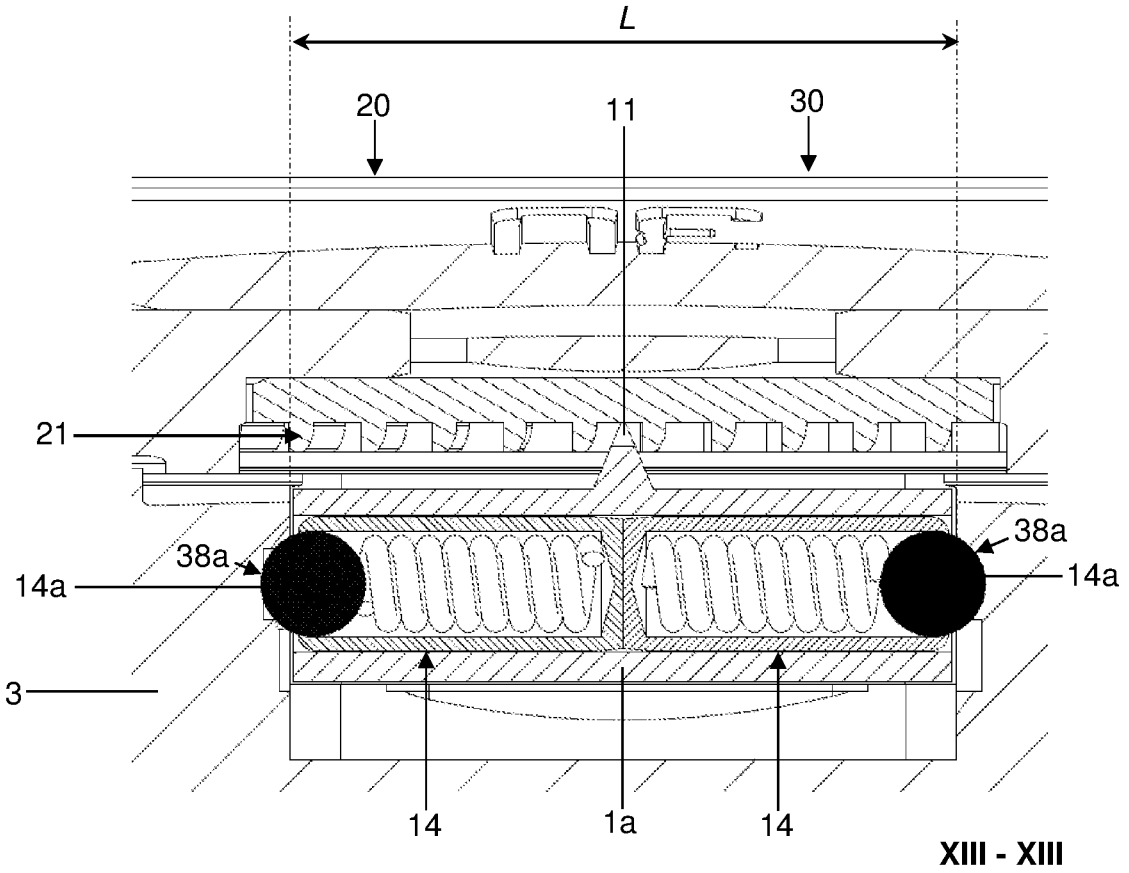
FIG. 13 is a cross-sectional view of an example of a case of the second embodiment of a timepiece, at the level of indexing elements, according to the first position of the end-link, the cross section being taken along the plane XIII-XIII of FIG. 10.
Figure 14:
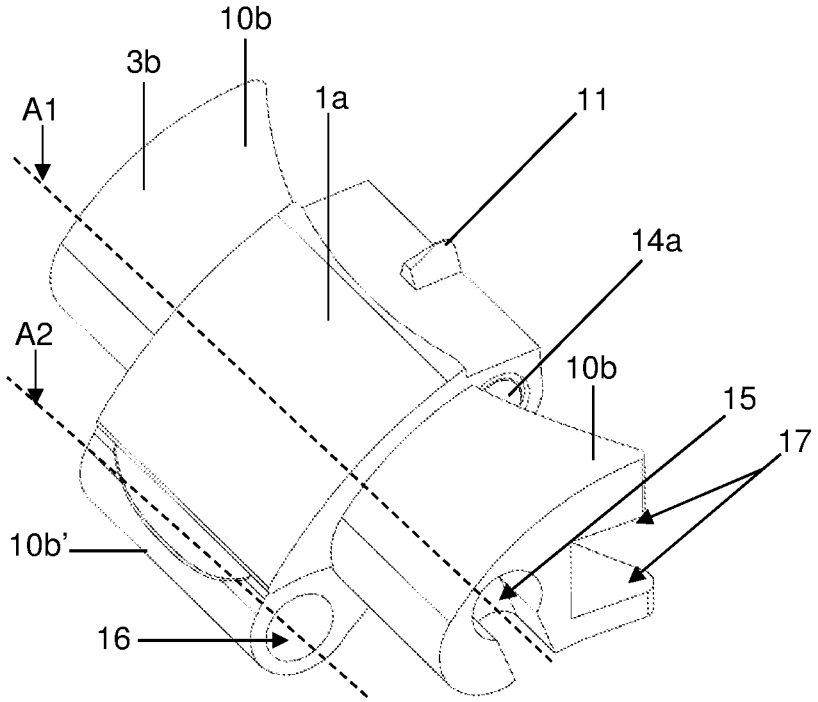
FIG. 14 is a perspective view of an example of an end-link of the second embodiment of a timepiece.

In the second embodiment represented in FIGS. 10 to 14, the end-link 1 is mounted rotationally mobile relative to the base 3*b* about the axis A1. The base 3*b* can take the form of a link forming two edge links 10*b* linked by a zone 10*b*' forming a center link. The end-link 1 covers, at least partially, the zone 10*b*'. The end-link 1 is mounted on the middle through a shaft 12 or a bar 12 forming an axis A1, which is provided to be housed in a through opening 15 of the end-link and of the base 3*b*. The base 3*b* is immobilized on the middle 3 through abutments 17 which prevent it from rotating about the bar 12 as represented in FIG. 14, while the end-link 1 is free to pivot about the bar.

Figure 10:
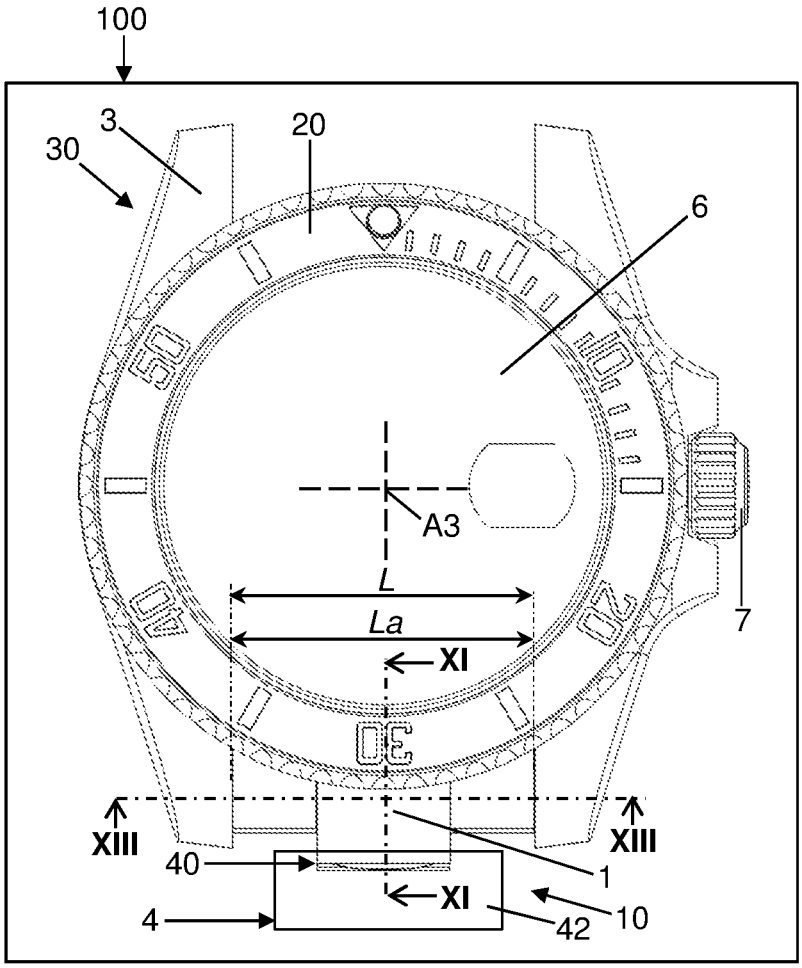
FIG. 10 illustrates a second embodiment of a timepiece according to the invention.

Preferentially, the base 3*b* also comprises a system 40 for linking the part 4 of the wrist band to the middle 3. This system 40 can, for example, take the form of a conventional link. It can, for example, comprise a bar 41 forming an axis A2, housed in an opening 16 of the base 3*b*, which is provided to pivot a first link 42 of the part 4 of the wrist band as represented in FIG. 10.

Figure 11:
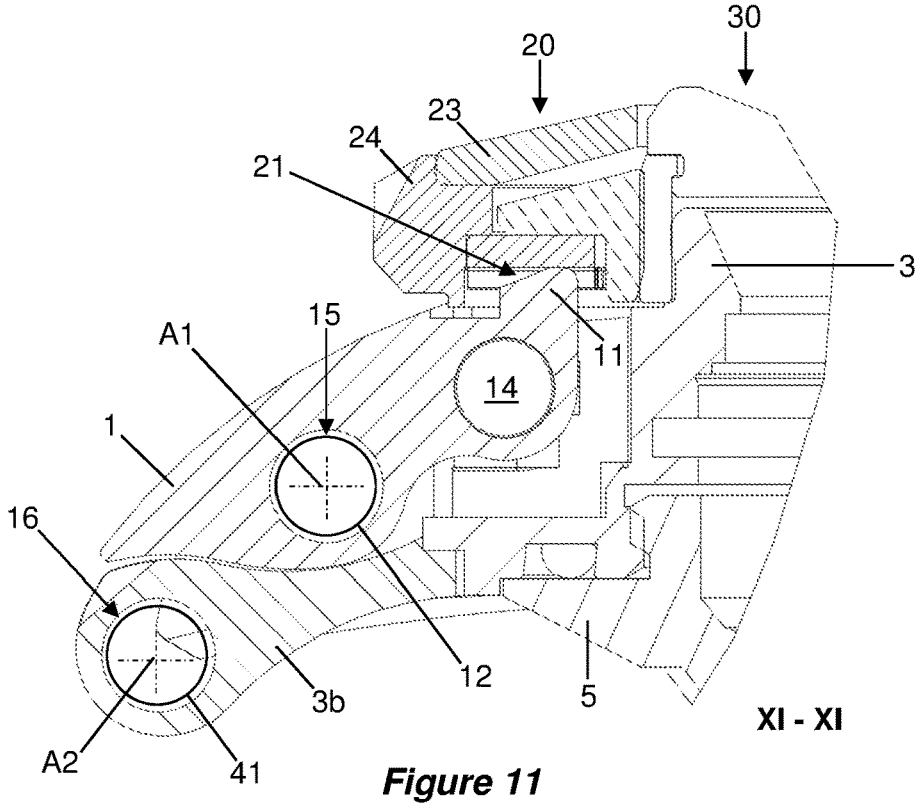
FIG. 11 is a cross-sectional view of an example of a case of the second embodiment of a timepiece, at the level of an end-link, the end-link being in a first configuration, the cross section being taken along the plane XI-XI of FIG. 10.

In a first configuration of the blocking device 10 represented in FIG. 11, the tooth 11 of the end-link 1 is positioned between two consecutive teeth of the teeth 21, thus blocking the rotation of the bezel 21. For this, the end-link 1 occupies a first position which is defined, for example, by the cooperation of the ball clicks 14 with each of the openings 38*a* as represented in FIG. 13.

Unlike the first embodiment of the blocking device 10, the end-link 1 is actuated, not by a pressure action, but by a pulling action slightly raising it so as to pivot it about the axis A1 and thus separate the tooth 11 from the teeth 21 to a second position defining a second configuration of the blocking device as represented in FIG. 12.

According to the second embodiment of the blocking device 10, the first teeth 21 cannot be retracted from the tooth 11 when the end-link 1 occupies the first position. Thus, the blocking device 10 constitutes a device for blocking the rotation of the bezel 20.

FIGS. 10 to 14 illustrate a bezel 20 forming an assembly of several components, namely a bezel disk 23, a bezel ring 24, and teeth 21 added onto said bezel ring 24. Alternatively, the bezel could take the form of a one-piece component.

Preferably, a case according to the invention comprises a single bezel blocking device disposed on the case at the level of a pair of horns of the middle. In this case, at the level of the other pair of horns, it is possible to dispose another end-link that does not form part of a blocking device. This other end-link advantageously has a form or an appearance similar to that of the end-link forming part of the blocking device.

Throughout this application, "bottom surface" is understood to mean a surface oriented toward the interior of the case, that is to say a surface not visible to an observer looking in the direction of the dial of the timepiece.

"Top surface" is understood to mean a surface oriented toward the outside of the case, that is to say a surface visible to an observer looking in the direction of the dial of the timepiece. It can thus be visible to the wearer of the watch.

One embodiment of a method for operating a case as described previously or a timepiece as described previously is described hereinbelow. The method comprises the following steps, these steps being notably implemented while the case or the timepiece is worn on the wrist of a wearer:

First action of the wearer to position the end-link in the second position of the end-link so as to allow the rotation of the rotating bezel, Possibly, action of the wearer on the rotating bezel so as to turn it about the axis A3 relative to the middle, Stopping of the first action of the wearer and/or second action of the wearer to position the end-link in the first position of the end-link so as to prevent the rotation of the rotating bezel.

In the solutions described, the means for fixing the wrist band part to the case, in particular to the middle, are independent of the means for fixing the end-link to the middle, such that the end-link can be manipulated by the wearer of the timepiece while the timepiece is worn on the wrist of the wearer.

By virtue of the solutions described previously, a rotating bezel blocking device can be proposed that is particularly well integrated in a predefined case design, which can be directly actuated by an end-link or a part of end-link mounted rotationally mobile relative to the case middle according to at least two positions, about a first axis of rotation parallel or substantially parallel to a second axis of a system for linking a wrist band part to said case.

The invention claimed is:

1. A case for a timepiece comprising:

a middle, a rotating bezel, and a device for blocking the rotating bezel, the device including an end-link, mounted mobile relative to the middle between a first position capable of preventing the rotation of the rotating bezel and a second position capable of allowing the rotation of the rotating bezel, the end-link including an action and/or gripping portion arranged so as to allow the wearer of the timepiece to move the end-link relative to the middle, when wearing the timepiece.

2. The case as claimed in claim 1, wherein the case comprises a first axis of articulation of the end-link relative to the middle and a second axis of fixing and/or of articulation of a wrist band part on the case, the first and second axes being parallel or substantially parallel.

3. The case as claimed in claim 2, wherein a distance between the first axis and the second axis is less than 10 mm or less than 5 mm.

4. The case as claimed in claim 3, wherein the position indexing element indexes comprises at least one click.

5. The case as claimed in claim 4, wherein the at least one click is a ball click.

6. The case as claimed in claim 1, wherein the case comprises a position indexing element for indexing positions, for the end-link relative to the middle.

7. The case as claimed in claim 1, wherein the end-link comprises a tooth intended to cooperate obstacle-wise, in the first position, with teeth of the bezel.

8. The case as claimed in claim 1, wherein the middle comprises two horns and the end-link has a width corresponding substantially to a distance separating the two horns of the case.

9. The case as claimed in claim 1, wherein the middle comprises two horns and the case includes a first shaft or a first bar housed between the two horns so as to pivotingly link the end-link relative to the middle.

10. The case as claimed in claim 9, wherein the case comprises a second shaft or a second bar mechanically linking the end-link to a wristlet part.

11. The case as claimed in claim 1, wherein the case comprises a system for linking the wrist band part to the middle.

12. The case as claimed in claim 1, wherein the middle comprises a base added onto a rest of the middle, on which the end-link is mounted mobile.

13. The case as claimed in claim 12, wherein the middle comprises two horns and the case includes a first shaft or a first bar housed between the two horns so as to mechanically link the base to the middle.

14. The case as claimed in claim 12, wherein the case comprises a second shaft or a second bar mechanically linking the base to a wrist band part.

15. The case as claimed in claim 1, wherein the middle comprises two horns and a width of the base corresponds substantially to a distance separating the two horns of the case.

16. A timepiece, notably a wrist watch, comprising a case as claimed in claim 1.

17. A method for operating a case as claimed in claim 1, the method comprising:

positioning, while the case is worn on a wrist of a wearer, the end-link in the second position of the end-link so as to allow rotation of the rotating bezel, and stopping the positioning of the end-link so as to prevent the rotation of the rotating bezel.

18. The case as claimed in claim 1, wherein the end-link comprises a tooth intended to cooperate obstacle-wise, in the first position, with top bezel teeth.

19. The case as claimed in claim 1, wherein the end-link comprises a tooth intended to cooperate obstacle-wise, in the first position, with bottom bezel teeth.

20. The case as claimed in claim 1, the action and/or gripping portion allow the wearer of the timepiece to move the end-link relative to the middle by a pressure action or a pulling action, when wearing the timepiece.

* * * * *